United States Patent [19]

Maziasz et al.

[11] Patent Number: 4,818,485

[45] Date of Patent: Apr. 4, 1989

[54] RADIATION RESISTANT AUSTENITIC STAINLESS STEEL ALLOYS

[75] Inventors: Philip J. Maziasz; David N. Braski; Arthur F. Rowcliffe, all of Oak Ridge, Tenn.

[73] Assignee: The United States of America as represented by the United States Department of Energy, Washington, D.C.

[21] Appl. No.: 13,471

[22] Filed: Feb. 11, 1987

[51] Int. Cl.[4] ..... C22C 38/44

[52] U.S. Cl. ..... 420/57; 148/327; 376/900

[58] Field of Search ..... 420/53, 57; 148/327; 376/900

[56] References Cited

U.S. PATENT DOCUMENTS

| | | | |
|---|---|---|---|
| 4,011,133 | 3/1977 | Bloom et al. | 420/53 |
| 4,158,606 | 6/1979 | Bloom et al. | 420/53 |

FOREIGN PATENT DOCUMENTS

| | | | |
|---|---|---|---|
| 106426 | 4/1984 | European Pat. Off. | 148/327 |
| 109221 | 5/1984 | European Pat. Off. | 148/327 |
| 58-177439 | 10/1983 | Japan | 420/53 |
| 60-155652 | 8/1985 | Japan | 420/53 |

OTHER PUBLICATIONS

Maziasz, "A Perspective on Present and Future Alloy Development . . . ", *J. Nucl. Mater.,* 133 & 134 (1985) pp. 134–140.

Maziasz, "Swelling and Swelling Resistance Possibilities . . . ", *J. Nucl. Mater.,* 122 & 123 (1984) pp. 472–486.

Maziasz, "Microstructural Stability and Control for Improved . . . ", *Am. Soc. for Testing & Matls.,* Phil., PA (1988) pp. 116–161.

Maziasz et al., "Modification of the Grain Boundary Microstructure of the Austenitic PCA Stainless Steel . . . ", *J. Nucl. Mater.,* 141–143 (1986), pp. 973–977.

Maziasz et al., "Microstructural Design of PCA Austenitic . . . ", *J. Nucl. Mater.* 122 & 123 (1984), pp. 305–310.

Maziasz et al., "Preirradiation Microstructural Development . . . ", *J. Nucl. Mater.* 103–104 (1981), pp. 797–802.

Maziasz et al., "Application of Quantitative EELS . . . ", 40th Annual EMSA Meeting, G. W. Bailey, Claitor's Publ. Div. (1982) pp. 498–499.

Fujiwara et al., "Development of Modified Type 316 Stainless . . . ", *Am. Soc. for Testing & Matls.,* Phil., PA (1987), pp. 127–145.

Igata et al., "Effects of Nitrogen and Carbon on Void Swelling . . . ", *J. Nucl. Mater.,* 122 & 123 (1984), pp. 219–223.

Swindeman et al., "Residual and Trace Element Effects . . . ", *Met. Trans. A,* 14A (1983), pp. 581–593.

Rowcliffe et al., Alloy Development for Irradiation Performance Semiannual Progress Report for Period Ending 3/31/84 (DOE/ER-0045/12).

Maziasz, Alloy Development for Irradiation Performance Semiannual Progress Report for Period Ending 9/30/84 (DOE/ER-0045/13).

Rowcliffe et al., *An Electron Microscope Investigation of High-Temperature Embrittlement of Irradiated Stainless Steels,* pp. 161–199.

Maziasz et al., *Preirradiation Microstructural Development Designed to Minimize Properties Degradation During Irradiation in Austenitic.*

Kesternich et al., *Reduction of Helium Embrittlement in Stainless Steel by Finely Dispersed TiC Precipitates,* 104 J. Nucl. Mat'ls. 845.

Maziasz et al., *Comparison of 316+Ti with 316 Stainless Steel Irradiated in a Simulated Fusion Environment,* Trans. Am. Nucl. Soc.

Martin et al., *Solutions to the Problems of High-Temperature Irradiation Embrittlement,* Effects of Radiation . . . , ASTM-STP-426.

*Primary Examiner*—Deborah Yee

*Attorney, Agent, or Firm*—Katherine P. Lovingood; Stephen D. Hamel; Judson R. Hightower

[57] ABSTRACT

An austenitic stainless steel alloy, with improved resistance to radiation-induced swelling and helium embrittlement, and improved resistance to thermal creep at high temperatures, consisting essentially of, by weight percent: from 16 to 18% nickel; from 13 to 17% chromium; from 2 to 3% molybdenum; from 1.5 to 2.5% manganese; from 0.01 to 0.5% silicon; from 0.2 to 0.4% titanium; from 0.1 to 0.2% niobium; from 0.1 to 0.6% vanadium; from 0.06 to 0.12% carbon; from 0.01% to 0.03% nitrogen; from 0.03 to 0.08% phosphorus; from 0.005 to 0.01% boron; and the balance iron, and wherein the alloy may be thermomechanically treated to enhance physical and mechanical properties.

9 Claims, 4 Drawing Sheets

1 μm 0.2 μm

100 μm

RADIATION RESISTANT AUSTENITIC STAINLESS STEEL ALLOYS

BACKGROUND OF THE INVENTION

This invention relates to austenitic stainless steel alloys which have improved resistance to both thermal creep and swelling when exposed to nuclear radiation. The alloys comprising the invention are basically nickel-chromium steel alloys which have closely controlled additions of minor alloying constituents. These minor alloying constituents, in the proper quantities, provide the resulting alloys with improved resistance to helium embrittlement and improved resistance to void swelling during irradiation, as well as thermal creep resistance.

The invention is a response to a continuing need for improved steel alloys for use in both radiation and high temperature environments. This need is particulary apparent in the area of nuclear fission or fusion reactors, as the intensely radioactive environment is extremely damaging to existing steel alloys. In particular, neutron irradiation of steel alloys used, for instance, as fuel element claddings or structural members, induces transmutation reactions which lead to the production of impurities such as helium. Although helium is an inert gas, it is highly insoluble in steel alloys and tends to form bubbles along the grain structure of the alloys. Furthermore, the presence of interstitial helium, and the damage caused by the irradiating neutrons, produce dimensional changes in the steel alloy, manifested as physical swelling, which has serious deleterious effects on the mechanical properties of the steel alloy and which may lead to failure. The results of irradiation, including embrittlement (loss of ductility) and swelling, inevitably shorten the useful life of the steel components, thereby having a significant negative economic impact on the nuclear power and research industries.

The damaging e ffects of helium embrittlement and swelling on the integrity of steel alloy reactor components are well known. In the prior art, efforts have been made to modify existing steel alloys by either changes in composition or by special thermomechanical treatment during fabrication. See, e.g., Bloom et al., U.S. Pat. No. 4,011,133, and Bloom et al., U.S. Pat. No. 4,158,606. In particular, some measure of success in swelling resistance has been achieved by increasing the concentrations of silicon and titanium in conventional austenitic stainless steel alloys. However, these alloys show only slightly greater resistance to radiation-induced embrittlement at elevated temperatures than do existing alloys such as type 316 stainless steel. This is because earlier efforts were aimed primarily at the problem of radiation-induced swelling alone without regard to the problem of helium embrittlement, which is a function not only of helium build up along grain boundaries, but also of grain boundary carbide distribution in the alloys. Some measure of success in reducing helium embrittlement during irradiation has been achieved by heat aging a titanium modified austenitic stainless steel to produce MC carbide along the grain boundaries prior to irradiation. See Maziasz & Braski, 141–143 *J. Nucl. Mat'ls*—(to be published in 1987). Consequently, there remains a need for improved steel alloys which offer greater resistance to both radiation-induced swelling and embrittlement than existing alloys.

SUMMARY OF THE INVENTION

Accordingly, it is an object of the present invention to provide an austenitic stainless steel alloy which has improved resistance to radiation-induced degradation due to swelling and embrittlement.

It is another object of the present invention to provide an austenitic stainless steel alloy which has improved resistance to thermal creep.

It is still another object of the present invention to provide an austenitic stainless steel alloy with improved durability and effective life in both radiation and high temperature environments.

It is still another object of the present invention to provide an austenitic stainless steel alloy with improved physical properties for use in nuclear engineering applications.

It is still another object of the present invention to provide an austenitic stainless steel alloy with improved physical properties that can be produced economically with conventional technology.

These objects are achieved by providing an austenitic stainless steel alloy consisting essentially of iron, nickel, and chromium, with the addition of closely controlled minor alloying quantities of molybdenum, manganese, silicon, titanium, niobium, vanadium, carbon, nitrogen, phosphorus, and boron.

In particular, an object of the invention is achieved by providing an austenitic stainless steel alloy, with improved resistance to radiation-induced swelling and embrittlement, and improved resistance to thermal creep at high temperatures, consisting essentially of, by weight percent: from 16 to 18% nickel; from 13 to 17% chromium; from 2 to 3% molybdenum; from 1.5 to 2.5% manganese; from 0.01 to 0.5% silicon; from 0.2 to 0.4% titanium; from 0.1 to 0.2% niobium; from 0.1 to 0.6% vanadium; from 0.06 to 0.12% carbon; from 0.01% to 0.03% nitrogen; from 0.03 to 0.08% phosphorus; from 0.005 to 0.01% boron; and the balance iron.

BRIEF DESCRIPTION OF THE DRAWINGS

FIG. 2(*b*) is a photomicrograph of the grain structure of a conventional steel alloy.

DETAILED DESCRIPTION OF THE PREFERRED EMBODIMENTS

Figure 1:
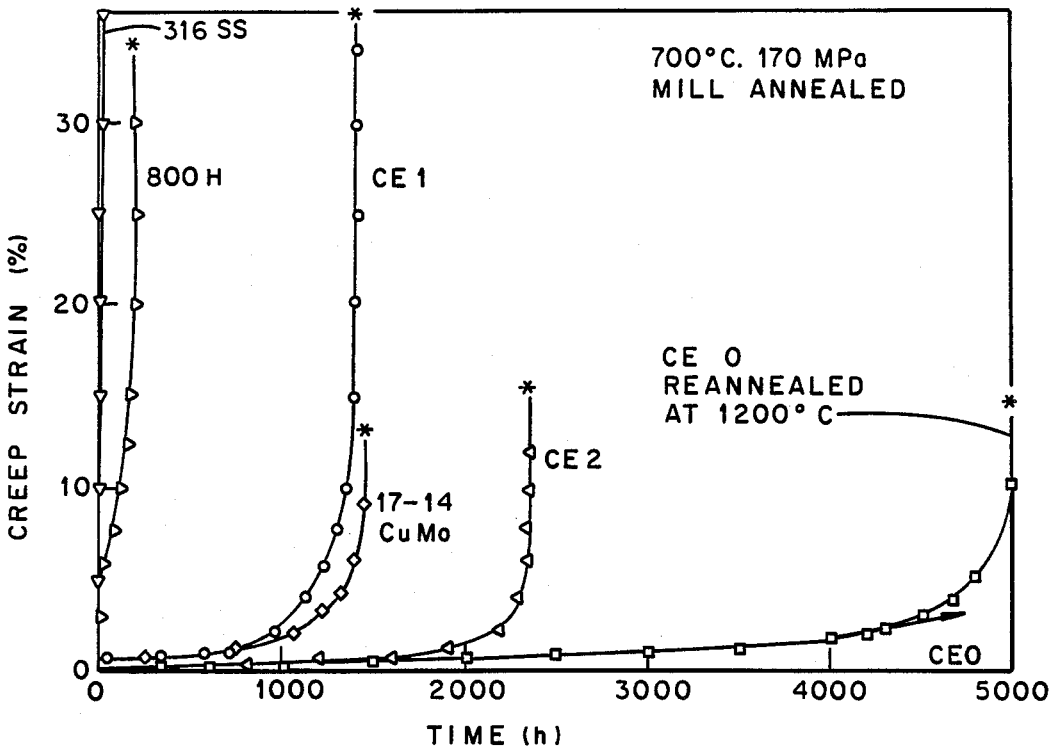
FIG. 1 is a graph of creep strain versus test time illustrating the thermal creep resistance at elevated temperature of alloys prepared according to the invention compared with conventional alloys.

The improvements in the physical properties of austenitic stainless steel alloys comprising this invention result from modifying the composition of conventional alloys with minor constituent elements. The modified compositions of the alloys, controlled by the alloying elements, provide the alloys prepared according to the invention with superior physical and mechanical properties. In addition, thermomechanical treatment, comprising solution annealing and heat aging prior to fabrication into desired final form, enhances these properties.

The improvements brought about by the present invention are a direct result of improved microstructure of the alloys. The microstructure of the alloys is susceptible to variations in carbide phase formation with only minor changes in alloying constituents. It is desirable to obtain both fine and coarse carbides, rather than coarse intermetallic phases in the grain boundary precipitate structure. Consequently, it is desirable to suppress formation of only $M_{23}C_6$ carbides, or Laves and sigma phases, in favor of a finer MC structure, with possibly a few coarse $M_{23}C_6$ particles mixed in as well, at the grain boundaries. Also, as the embodiments of the present invention indicate, phosphide formation in the matrix plays a role in imparting improved resistance to both swelling and embrittlement under irradiation.

For the sake of convenience, the alloys prepared according to the invention will be referred to as CE alloys. It has been found that increased nitrogen and boron levels in the CE alloys, in combination with a slightly higher level of phosphorus, and inclusion of titanium, vanadium, and niobium together, results in the improved microstructures of the embodiments of the present ivvention. The ranges for the various constituent elements in the CE alloys are as follows: from 16 to 18% nickel; from 13 to 17% chromium; from 2 to 3% molybdenum; from 1.5 to 2.5% manganese; from 0.01 to 0.5% silicon; from 0.2 to 0.4% titanium; from 0.1 to 0.2% niobium; from 0.1 to 0.6% vanadium; from 0.06 to 0.12% carbon; from 0.01% to 0.03% nitrogen; from 0.03 to 0.08% phosphorus; from 0.005 to 0.01% boron; and the balance iron.

Preferred ranges for the constituent elements are as follows: from 16 to 16.5% nickel; from 13 to 16.5% chromium; from 2.2 to 2.5% molybdenum; from 1.6 to 1.9% manganese; from 0.2 to 0.45% silicon; from 0.2 to 0.35% titanium; from 0.1 to 0.15% niobium; from 0.5 to 0.6% vanadium; from 0.08 to 0.1% carbon; from 0.015 to 0.02% nitrogen; from 0.03 to 0.07% phosphorus; from 0.005 to 0.008% boron; and the balance iron.

The compositions of the CE alloys, and representative examples of previous experimental alloys and conventional reference alloys, are indicated in Table 1. The Prime Candidate Alloy (PCA) K280 heat, and an earlier series of experimental, modified PCA, alloys, are listed in Table 1 for comparison purposes.

TABLE 1

COMPOSITIONS OF REFERENCE, EXPERIMENTAL, AND CE ALLOYS

| ALLOY[1] | Ni | Cr | Mo | Mn | Si | Ti | Nb | V | C | N | P | B |
|---|---|---|---|---|---|---|---|---|---|---|---|---|
| Reference 316 (DO-heat) | 13 | 18 | 2.6 | 1.9 | 0.8 | 0.05 | — | — | 0.05 | — | 0.01 | 0.0005 |
| Reference 316 (N-Lot) | 13.5 | 16.5 | 2.5 | 1.6 | 0.5 | — | — | — | 0.05 | — | 0.01 | 0.0008 |
| Reference 316 (x-15893) | 12.4 | 17.3 | 2.2 | 1.7 | 0.7 | — | 0.01 | — | 0.05 | — | 0.03 | 0.0004 |
| Reference 316+Ti (R1-heat) | 12 | 17 | 2.5 | 0.5 | 0.4 | 0.23 | — | — | 0.06 | — | 0.01 | — |
| Reference[2] 800 H | 32.0 | 20.0 | — | 1.0 | 0.5 | 0.40 | — | — | 0.08 | — | 0.03 | — |
| Reference 17-14 Cu Mo[3] | 14.0 | 16.0 | 2.5 | — | 0.5 | 0.25 | 0.45 | — | 0.12 | — | 0.03 | — |
| PCA (K280)[4] | 16 | 14 | 2.5 | 1.9 | 0.4 | 0.25 | — | — | 0.05 | 0.02 | 0.01 | 0.0004 |
| PCA-19 | 15.9 | 13.8 | 2.4 | 2.1 | 0.4 | 0.28 | 0.1 | 0.5 | 0.08 | 0.002 | 0.03 | <0.001 |
| PCA-20 | 16.1 | 13.8 | 2.5 | 2.1 | 0.4 | 0.28 | 0.1 | 0.5 | 0.08 | 0.006 | 0.07 | 0.001 |
| PCA-21 | 15.8 | 15.8 | 2.4 | 3.4 | 0.4 | 0.27 | 0.1 | 0.5 | 0.08 | 0.006 | 0.06 | 0.001 |
| PCA-22 | 15.9 | 13.8 | 2.4 | 2.5 | 0.4 | 0.28 | 0.1 | 0.5 | 0.08 | 0.004 | 0.03 | 0.003 |
| CE-0 | 16.19 | 13.14 | 2.30 | 1.64 | 0.21 | 0.21 | 0.12 | 0.52 | 0.085 | 0.016 | 0.076 | 0.005 |
| CE-1 | 16.0 | 14.2 | 2.45 | 1.80 | 0.41 | 0.24 | 0.10 | 0.57 | 0.072 | 0.015 | 0.071 | 0.005 |
| CE-2 | 16.0 | 16.13 | 2.26 | 1.89 | 0.26 | 0.31 | 0.11 | 0.58 | 0.079 | 0.017 | 0.069 | 0.005 |

[1]All FIGS. are weight percentages, with the balance consisting essentially of Fe
[2]Also contains 0.5% Cu
[3]Also contains 3.0% Cu
[4]Prime Candidate Alloys An additional feature of the present invention is its ability to benefit from an innovative thermomechanical treatment which enhances the physical properties of the resulting alloys. This thermomechanical treatment consists of solution annealing the alloys in order to improve the dispersion of alloying constituents throughout the alloy, thereby leading to more uniform grain boundary precipitate structure. This thermomechanical treatment is necessary for helium embrittlement resistance during irradiation, but may not be required for optimum thermal creep resistance in an application not involving irradiation. It was found that the physical properties of the resulting alloys were optimized after solution annealing at temperatures ranging from about 1100° to 1300° C. for at least about 1 hour. The optimum temperature range for solution annealing was found to be from about 1150° to 1200° C. for at least about 1 hour.

In addition to solution annealing, the improved alloys may be subjected to heat aging and/or cold working prior to fabrication into the desired product. This additional thermomechanical treatment enhances the physical and mechanical properties of the alloys prepared according to the invention. Cold working the alloys up to about 30 percent has been found to be beneficial. It is desirable to heat age the alloys for at least 100 hours at a temperature of at least 800° C. after solution annealing, but before cold working.

It is important to note that the improved steel alloys of the present invention may be fabricated into finished parts by conventional methods. The alloys may be cast, worked, machined, or otherwise formed by techniques used with existing steel alloys.

EXAMPLES

The alloys of the invention, CE alloys CE-0 through CE-2, were prepared using standard commercial methods. This is unlike typical experimental alloys, which are generally prepared under laoratory conditions in inert atmospheres which may lead to erroneous results compared to commercial practices (ie., commercially prepared steels are exposed to oxygen and nitrogen throughout the process). This factor enhances the utility of the invention, as preparation of the CE alloys involves no special procedures or equipment. Likewise, the CE alloys may be fabricated into desired form by conventional techniques. The specific compositions of the CE alloys are listed, as noted before, in Table 1.

After the CE alloys were prepared, they were either mill annealed above 1200° C., or subsequently reannealed for 1 hour at 1120° C. Some of the reannealed samples were heat aged for 166 hours at 800° C.

The results of testing the experimental CE alloys along with conventional alloys show that both the grain boundary precipitate structure and the thermal creep resistance are measurably improved. The dramatic increase in thermal creep resistance of the mill annealed CE-0 samples without additional heat aging is shown in FIG. 1.

Figure 2A:
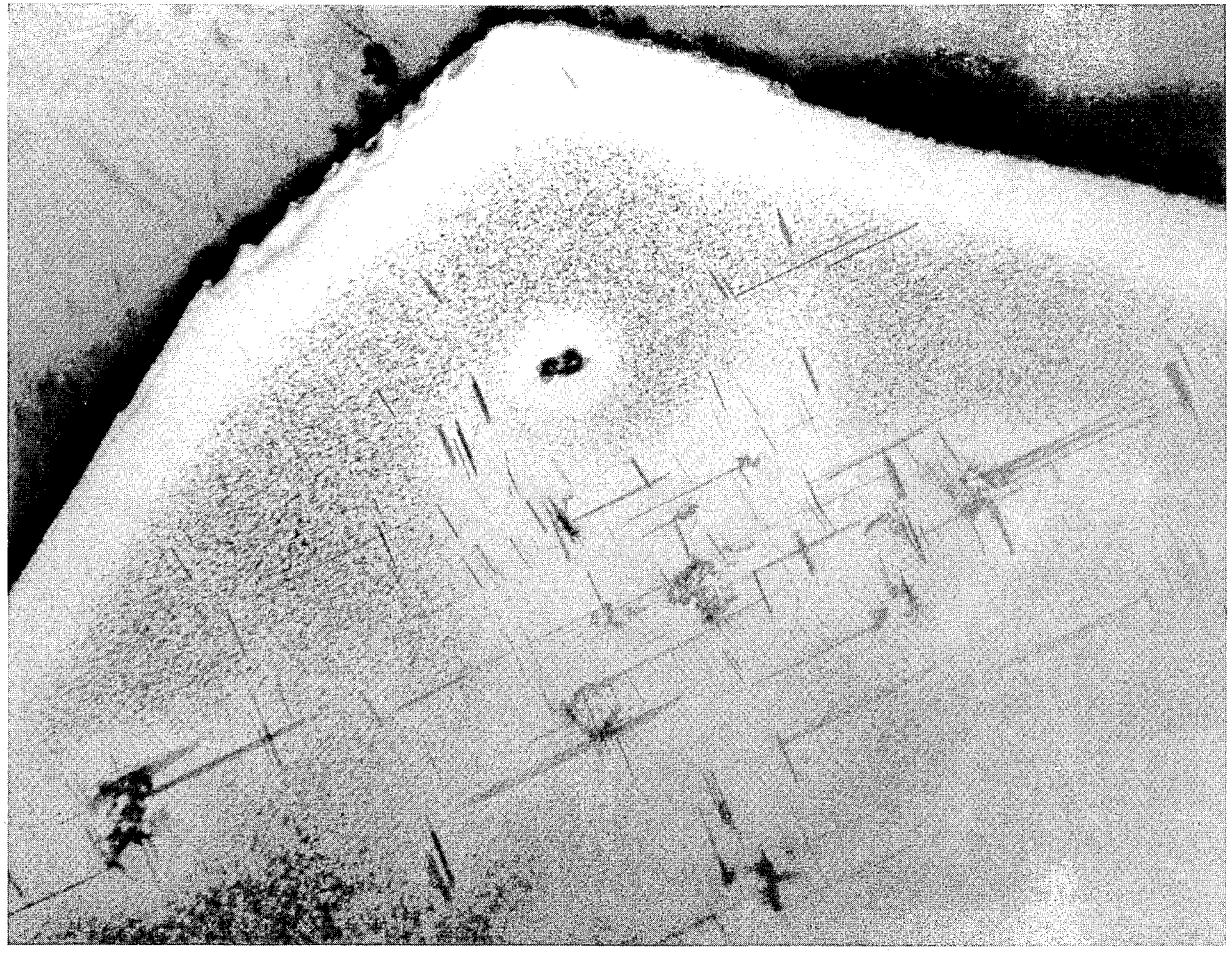
FIG. 2(*a*) is a photomicrograph of the grain structure of an alloy prepared according to the invention.
Figure 2B:
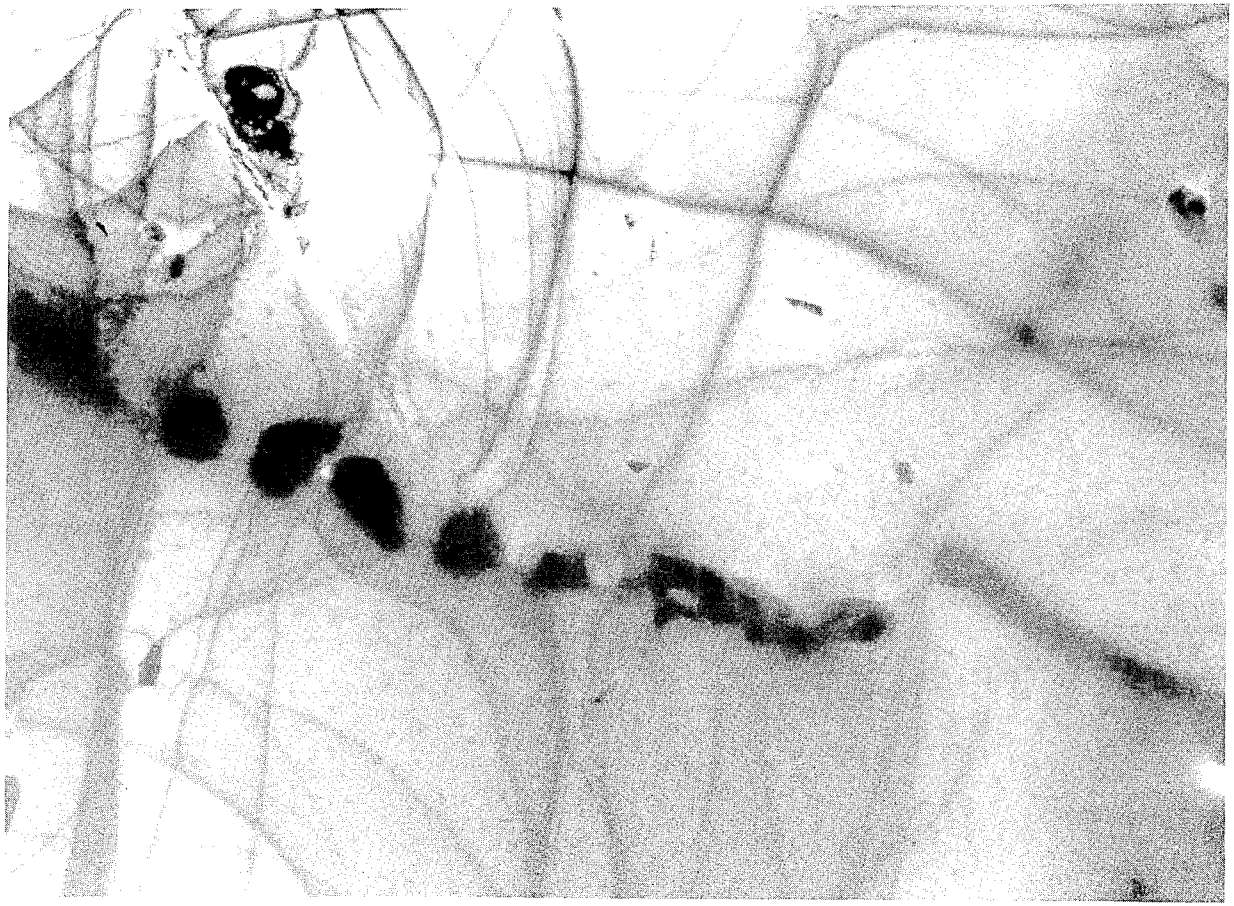
Figure 3A:
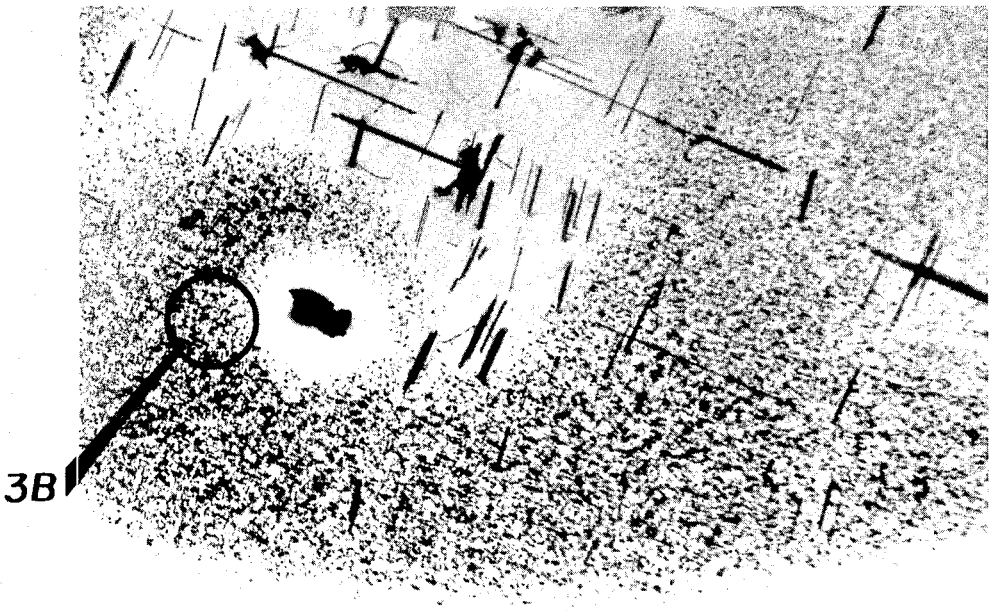
FIGS. 3(*a*), 3(*b*) and 3(*c*) show low and high magnification photomicrographs of a section of an alloy prepared according to the invention illustrating fine dispersion of phosphide needles.
Figure 3B:
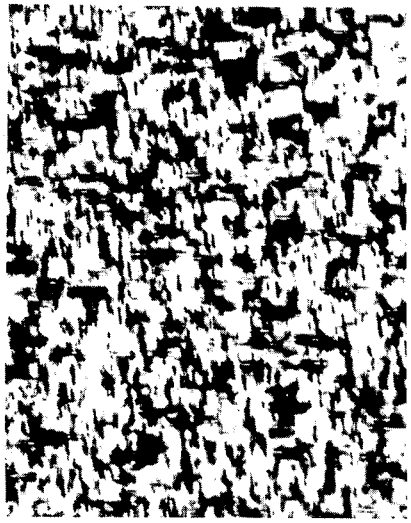
Figure 3C:
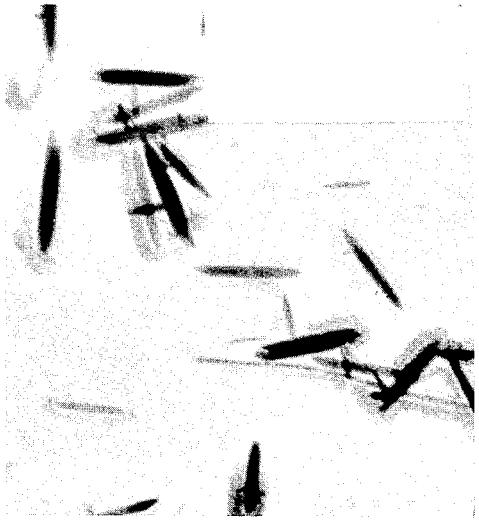

FIGS. 2(*a*) and 2(*b*) illustrate the grain structure of alloy CE-1 and that of a conventional Type 316 stainless steel, respectively. The CE-1 alloy, shown in FIG. 2(*a*), displays fine and coarse phosphides and coarse MC in the matrix with coarse $M_{23}C_6$ and fine MC at the grain boundaries. The fine phosphides, illustrated in successively magnified views in FIGS. 3(*a*), 3(*b*) and 3(*c*) are a significant source of creep strength and irradiation resistance. The conventional Type 316 alloy, as seen in FIG. 2(*b*), contains course intermetallic Laves phase particles and carbides at the grain boundaries, whereas the alloys of the present invention contain only $M_{23}C_6$ and MC carbides with no intermetallic phases. This is a significant improvement, as intermetallic phases at the grain boundaries degrade both creep rupture life and embrittlement resistance under irradiation. It is evident that the combination of compositional changes and optimized thermomechanical treatment results in austenitic stainless steel alloys with significantly improved properties over conventional alloys.

It should be understood that the invention contemplates austenitic stainless steel alloys comprising the aforementioned constituent elements with the balance consisting essentially of iron. As with other metallurgical art processes or compositions, any specified alloy may also contain unspecified incidental ingredients which are inevitably encountered in steel-making processes. These incidental ingredients do not affect the physical or chemical properties of the alloys and are, therefore, within the scope contemplated by the invention.

What is claimed is:

1. An austenitic stainless steel alloy, with improved reistance to radiation-induced swelling and embrittlement, and improved resistance to thermal creep at high temperatures, consisting essentially of, by weight percent: from 16 to 18% nickel; from 13 to 17% chromium; from 2 to 3% molybdenum; from 1.5 to 2.5% manganese; from 0.01 to 0.5% silicon; from 0.2 to 0.4% titanium; from 0.1 to 0.2% niobium; from 0.1 to 0.6% vanadium; from 0.06 to 0.12% carbon; from 0.01% to 0 03% nitrogen; from 0.03 to 0.08% phosphorus; from 0.005 to 0.01% boron; and the balance iron.

2. An austenitic stainless steel alloy as claimed in claim 1, wherein said alloy consists essentially of, by weight percent: from 16 to 16.5% nickel; from 13 to 16.5% chromium; from 2.2 to 2.5% molybdenum; from 1.6 to 1.9% manganese; from 0.2 to 0.45% silicon; from 0.2 to 0.35% titanium; from 0.1 to 0.15% niobium; from 0.5 to 0.6% vanadium; from 0.08 to 0.10% carbon; from 0.015 to 0.02% nitrogen; from 0.03 to 0.07% phosphorus; from 0.005 to 0.008% boron; and the balance iron.

3. An austenitic stainless steel alloy as claimed in claim 1, wherein said alloy has been subjected to solution annealing.

4. An austenitic stainless steel alloy as claimed in claim 3, wherein said solution annealing has been carried out at a temperature of from about 1100° to 1300° C. for at least about 1 hour.

5. An austenitic stainless steel alloy as claimed in claim 4, wherein said solution annealing has been carried out at a temperature of from about 1150° to 1200° C. for at least about 1 hour.

6. An austenitic stainless steel alloy as claimed in claim 3, wherein said alloy has been cold worked.

7. An austenitic stainless steel alloy as claimed in claim 3, wherein said alloy has been heat aged following solution annealing.

8. An austenitic stainless steel alloy as claimed in claim 7, wherein said alloy has been heat aged at a temperature of greater than 800° C. for at least about 100 hours.

9. An austenitic stainless steel alloy as claimed in claim 8, wherein said alloy has been cold worked af... heat aging.

* * * * *